US010836599B2

(12) United States Patent
Shimmachi et al.

(10) Patent No.: US 10,836,599 B2
(45) Date of Patent: Nov. 17, 2020

(54) PRINTING APPARATUS

(71) Applicant: CANON KABUSHIKI KAISHA, Tokyo (JP)

(72) Inventors: Masaya Shimmachi, Kawasaki (JP); Yasuhito Tsubakimoto, Tokyo (JP); Yuji Kanome, Yokohama (JP); Kaneto Tokuyama, Tokyo (JP); Takashi Awai, Chiba (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 15/992,677

(22) Filed: May 30, 2018

(65) Prior Publication Data

US 2018/0354739 A1 Dec. 13, 2018

(30) Foreign Application Priority Data

Jun. 9, 2017 (JP) ..... 2017-114342

(51) Int. Cl.
*B65H 31/20* (2006.01)
*G03G 15/00* (2006.01)
*B65H 31/02* (2006.01)

(52) U.S. Cl.
CPC ..... *B65H 31/20* (2013.01); *B65H 31/02* (2013.01); *G03G 15/6552* (2013.01); *B65H 2402/32* (2013.01); *B65H 2402/46* (2013.01); *B65H 2405/11151* (2013.01); *B65H 2405/111646* (2013.01); *B65H 2405/324* (2013.01); *B65H 2801/06* (2013.01); *B65H 2801/12* (2013.01)

(58) Field of Classification Search
CPC ..... B65H 31/20; B65H 2405/1122; B65H 2405/1124; B65H 2405/1132; B65H 2405/1134; B65H 2405/1136; B65H 2405/324
USPC ..... 271/213, 223
See application file for complete search history.

(56) References Cited

U.S. PATENT DOCUMENTS 8,172,222 B2 * 5/2012 Yoda ..... B65H 31/02 271/162
8,348,263 B2 * 1/2013 Otani ..... B65H 31/20 271/207
8,448,942 B2 * 5/2013 Otani ..... B65H 31/02 271/213
8,690,147 B2 * 4/2014 Okuchi ..... B65H 1/04 271/162

(Continued)

FOREIGN PATENT DOCUMENTS

JP 2011-241057 A 12/2011
JP 2013-039797 A 2/2013
JP 2017-088263 A 5/2017

OTHER PUBLICATIONS

Office Action dated Apr. 14, 2020, in Japanese Patent Application No. 2017-114342.

*Primary Examiner* — Michael McCullough
(74) *Attorney, Agent, or Firm* — Venable LLP

(57) ABSTRACT

In a printing apparatus, a first tray is capable of stacking a sheet discharged from a discharge port. A second tray is accommodated in a lower side of the first tray and is capable of stacking the sheet discharged from the discharge port by being drawn out in a sheet discharging direction from the discharge port. A changing unit changes inclination angles of the first tray and the second tray with respect to the sheet discharging direction according to a drawn-out position of the second tray.

11 Claims, 11 Drawing Sheets

(56) References Cited

U.S. PATENT DOCUMENTS

| | | | | |
|---|---|---|---|---|
| 8,757,794 | B2 | 6/2014 | Takemura et al. | |
| 9,162,842 | B2 * | 10/2015 | Komuro | B65H 31/20 |
| 9,242,827 | B2 * | 1/2016 | Niimura | B65H 31/22 |
| 9,513,589 | B2 * | 12/2016 | Arimura | B65H 31/20 |
| 9,598,257 | B2 * | 3/2017 | Komuro | B65H 31/20 |
| 10,087,031 | B2 | 10/2018 | Otsuka et al. | |
| 2011/0101601 | A1 * | 5/2011 | Yoda | B65H 31/02<br>271/163 |
| 2011/0278789 | A1 * | 11/2011 | Otani | B65H 31/20<br>271/207 |
| 2011/0285077 | A1 * | 11/2011 | Otani | B65H 31/02<br>271/213 |
| 2014/0167349 | A1 * | 6/2014 | Niimura | B65H 31/22<br>271/213 |
| 2014/0319760 | A1 * | 10/2014 | Komuro | B65H 31/20<br>271/223 |
| 2016/0147189 | A1 * | 5/2016 | Arimura | G03G 15/6552<br>271/213 |

* cited by examiner

PRINTING APPARATUS

BACKGROUND OF THE INVENTION

Field of the Invention

The present invention relates to a printing apparatus including a tray capable of stacking printed sheets.

Description of the Related Art

Japanese Patent Laid-Open No. 2011-241057 describes a printing apparatus that discharges a printed sheet from a discharge port onto a tray (stacker). The tray includes a first tray (first stacker) that is positioned on the upstream side in a sheet discharging direction and a second tray (second stacker) that is positioned on the downstream side in the discharging direction. The first tray is inclined upward at a certain angle toward the downstream side in the discharging direction, and the second tray can be drawn out from the lower side of the first tray toward the downstream side in the discharging direction. The drawing-out angle thereof is the same as a constant angle at which the first tray is inclined.

SUMMARY OF THE INVENTION

In an apparatus described in Japanese Patent Laid-Open No. 2011-241057, there is a sheet discharge port on a front side of a main body of the printing apparatus, and the tray is drawn out ahead of this discharge port. For example, if the maximum paper size is A4, a tray stacking area larger than the A4 paper is required in front of the main body of the apparatus, and thus, a large occupied floor area is required as a whole. In order to reduce the occupied floor area, a layout where the discharge port is positioned inside the apparatus is considered. In that case, the vicinity of the discharge port becomes a narrow space which is opened at the front side surrounded by the upper portion and the right and left side portions, and when the user wishes to access the mechanism inside the main body of the apparatus for maintenance or the like, the user performs a task of inserting his or her hand through the narrow space. For this reason, how much the closed space in the vicinity of the discharge port is allowed to be expanded becomes a task to improve the maintenance workability.

The invention provides a printing apparatus with high maintenance workability by a user.

In an aspect of the present invention, there is provided a printing apparatus comprising:

a printing unit configured to print on a sheet;

a discharge port configured to discharge a sheet printed on by the printing unit;

a first tray configured to be capable of stacking the sheet discharged from the discharge port;

a second tray configured to be accommodated in a lower side of the first tray and to be capable of stacking the sheet discharged from the discharge port by being drawn out in a sheet discharging direction from the discharge port; and a changing unit configured to change inclination angles of the first tray and the second tray with respect to the sheet discharging direction according to a drawn-out position of the second tray.

According to the invention, since inclination angles of first and second trays are changed according to a drawn-out state of the second tray, maintenance workability by a user is improved.

Further features of the present invention will become apparent from the following description of exemplary embodiments with reference to the attached drawings.

DESCRIPTION OF THE EMBODIMENTS

Hereinafter, embodiments of the present invention will be exemplarily described with reference to the drawings. Sizes, shapes, relative arrangements, and the like of components described in the following embodiments are to be appropriately changed depending on the configuration of an apparatus to which the present invention is applied and various conditions. Unless otherwise specified, the scope of the invention is not limited thereto.

First Embodiment

A printing apparatus according to an embodiment described below is an example of application as an inkjet printing apparatus. In addition, the present invention can be applied not only to printing apparatuses using systems other than an inkjet system, but also to sheet stacking apparatuses in various sheet processing apparatuses (apparatuses that perform sheet reading, inspecting, processing, and the like).

Figure 1:
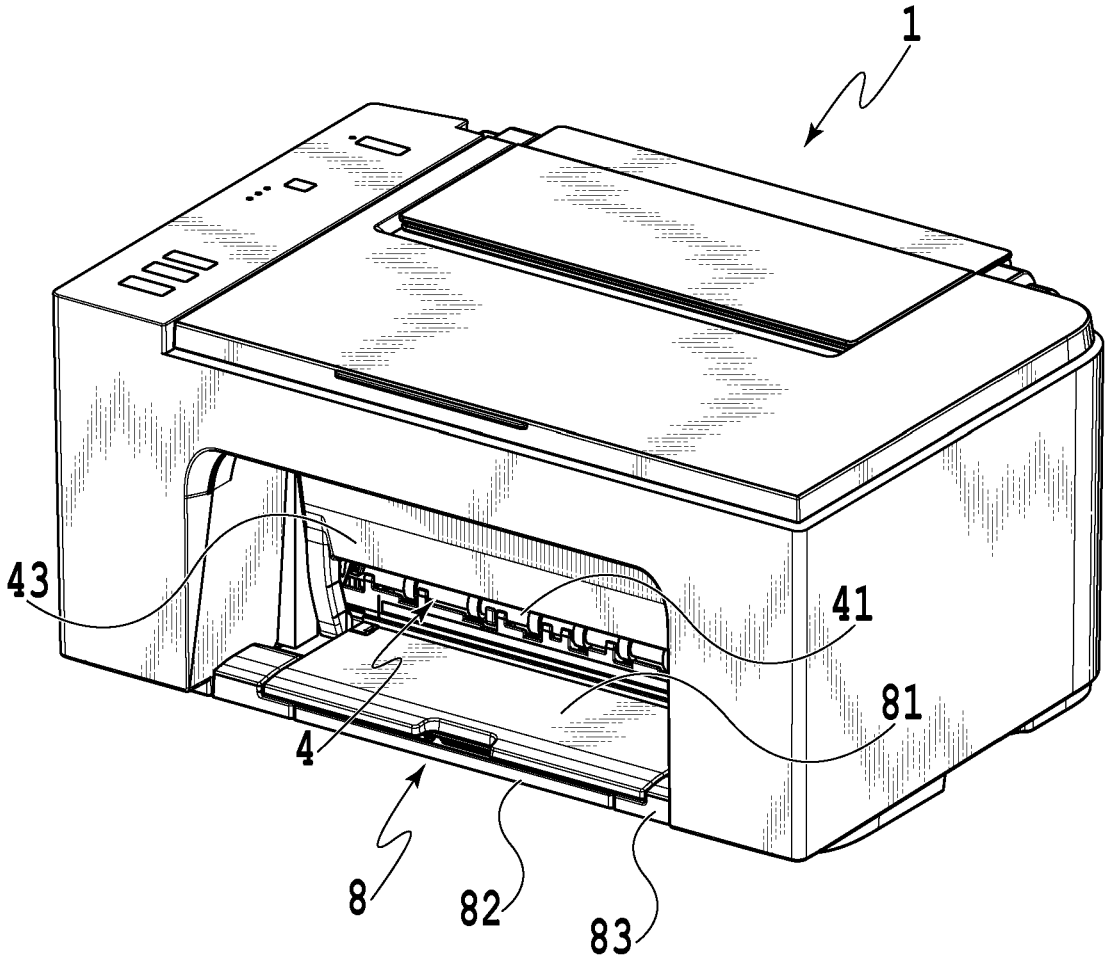
FIG. 1 is a perspective view of a printing apparatus according to a first embodiment of the invention.
Figure 2:
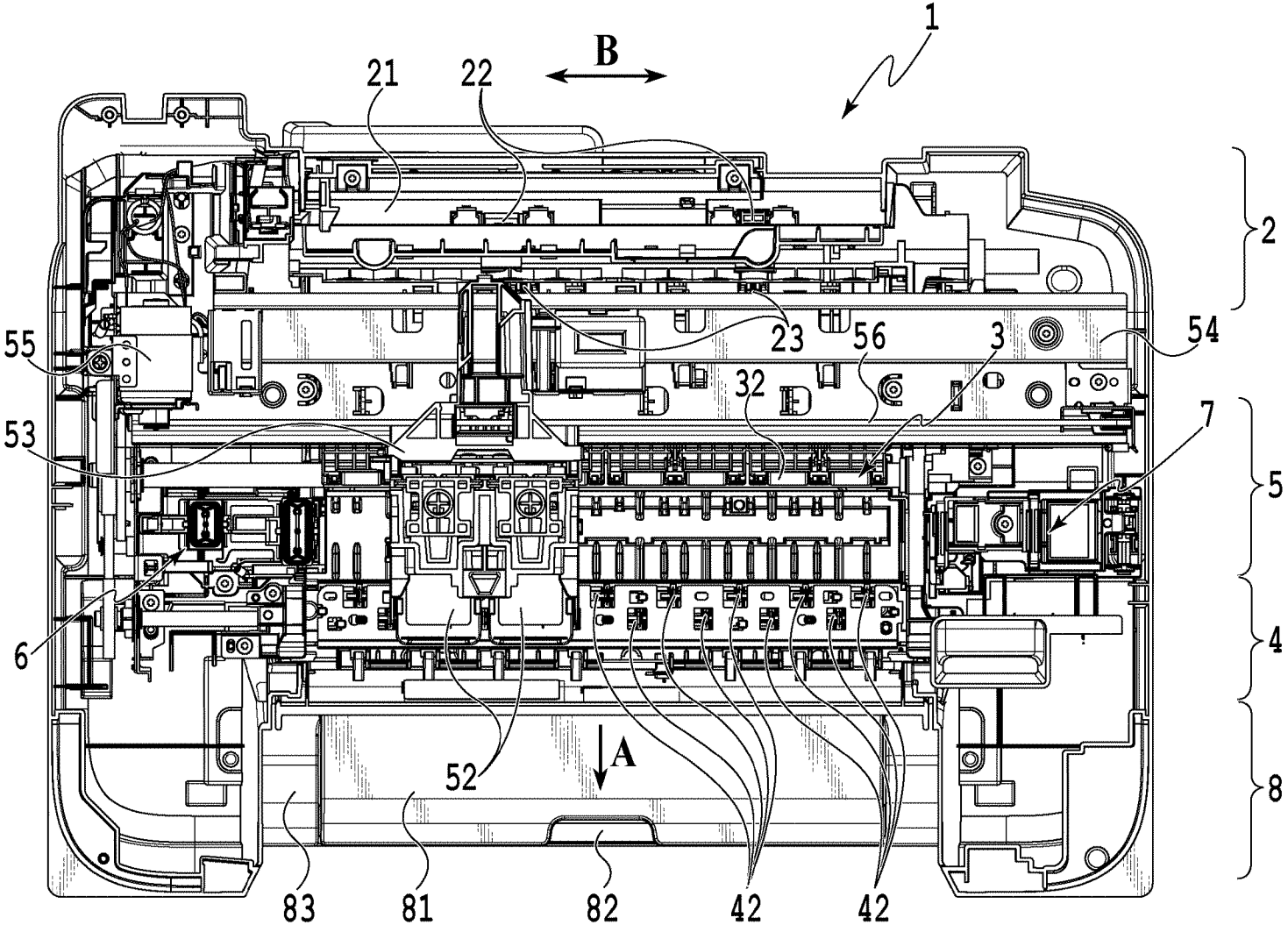
FIG. 2 is a top view illustrating an internal configuration of the printing apparatus of FIG. 1.
Figure 3:
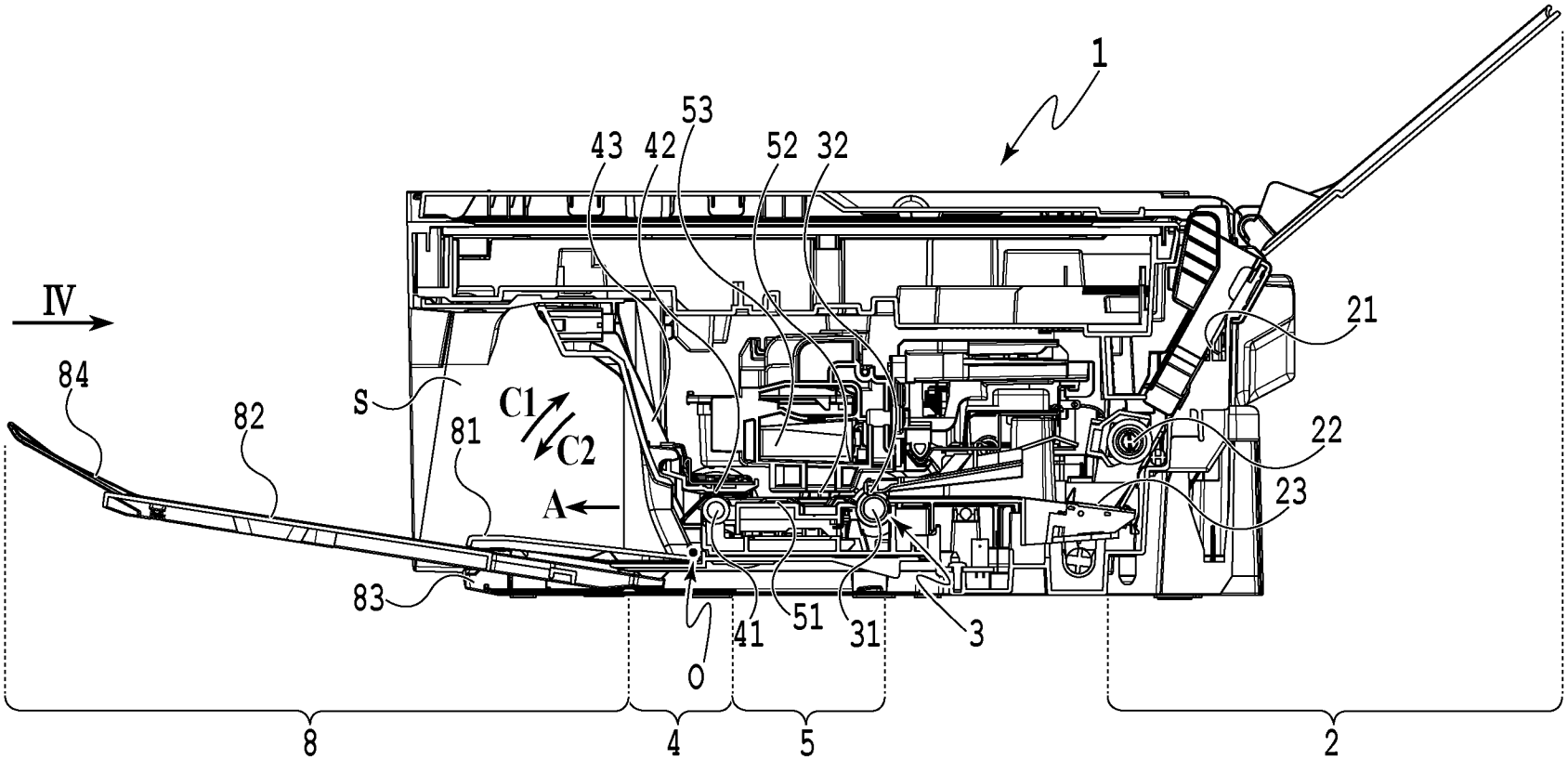
FIG. 3 is a cross-sectional view of the printing apparatus of FIG. 1.
Figure 4:
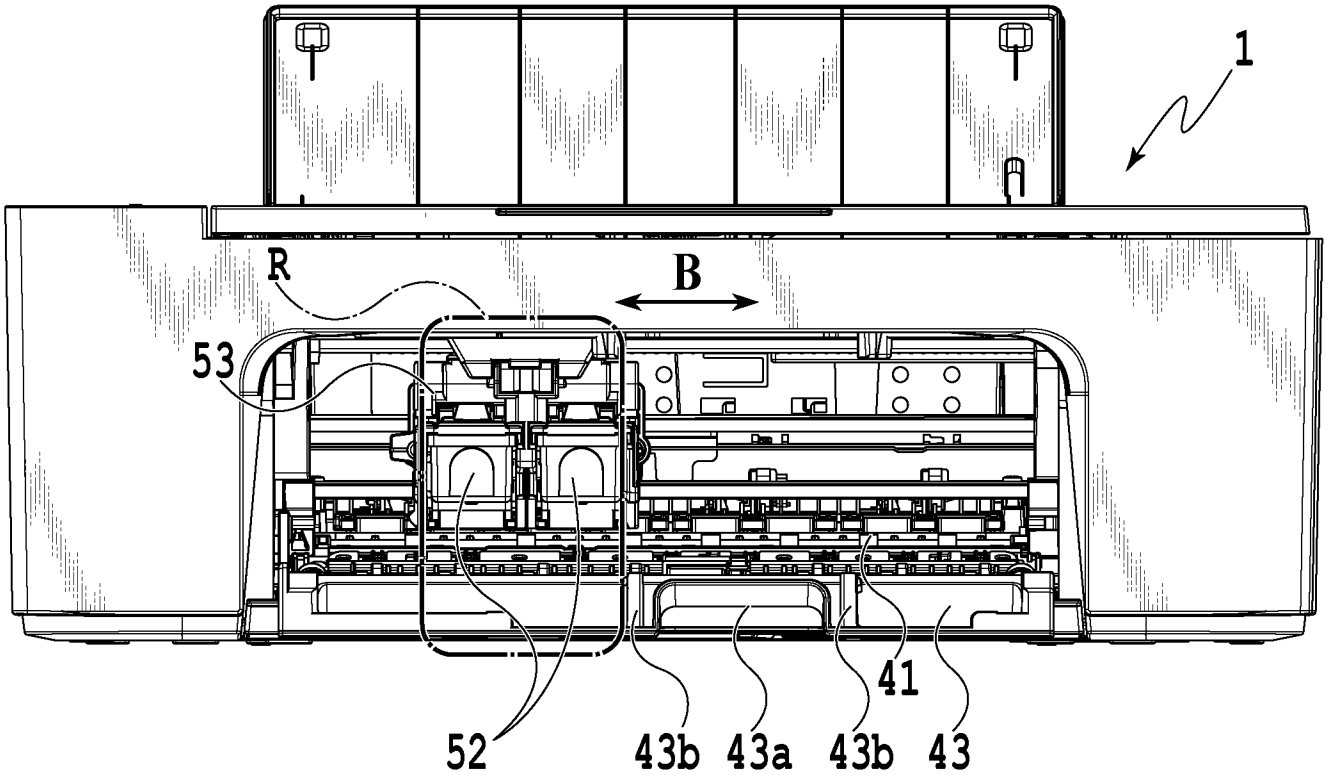
FIG. 4 is a view taken along a direction of arrow IV in FIG. 3 in a state where an access cover is opened.

FIG. 1 is a perspective view of an overall inkjet printing apparatus (hereinafter, referred to as a printing apparatus) 1, FIG. 2 is a top view of the inside of the printing apparatus 1, FIG. 3 is a cross-sectional view of the printing apparatus 1, and FIG. 4 is a front view of the printing apparatus 1 when an access cover is opened.

The printing apparatus 1 includes a supply unit 2 for a sheet as a print medium, a sheet transporting unit 3, a sheet discharge port 4, a printing unit 5, a capping unit 6, a wiping unit 7, and a discharge tray unit 8. In the supply unit 2, sheets stacked on a stacking surface 21 are fed by a pickup roller 22, and the sheets are separated one by one by a separation unit 23 and then transported to the transporting unit 3. The sheet transported to the transporting unit 3 is transported to the printing unit 5 after inclined movement is corrected by a transporting roller 31 and a driven roller 32. An image is printed on the sheet by a print head 52 in a state where the sheet transported to the printing unit 5 is supported on a platen 51. The print head 52 is detachably attached to a carriage 53. The carriage 53 is supported by a chassis 54 so as to be movable in a main scanning direction (direction of arrow B) intersecting (in this example, perpendicular to) a transport direction (direction of arrow A) of the sheet. The driving force of a carriage driving motor 55 is transmitted to the carriage 53 by a transmission belt 56, so that the carriage 53 is reciprocated in the main scanning direction. By repeating the printing operation of ejecting ink while the print head 52 together with the carriage 53 moves in the direction of arrow B and the transporting operation of transporting the sheet by a predetermined amount in the direction of arrow A, an image is printed on the sheet.

The sheet on which the image is printed is transported to the discharge port 4 (discharge portion) and discharged onto the discharge tray unit 8 from the discharging direction along the transport direction by a roller 41 and a spur 42. The capping unit 6 that caps and protects the ink ejecting portion of the print head 52 is provided on one end side of the moving region of the carriage 53, and the wiping unit 7 that cleans the ink ejecting portion of the print head 52 is provided on the outer end side thereof.

A narrow space S (access space) positioned above at least a portion of a first tray 81 is formed inside a main body of the printing apparatus 1. In other words, the space S is formed on the lower side of the main body of the printing apparatus and above the first tray 81 and is opened on the front side of the main body of the printing apparatus. The discharge port 4 is positioned on the back side of the space S. The user access through this space S to the internal mechanism of the printing apparatus 1 positioned above the discharge port 4 is permitted.

Figure 8A:
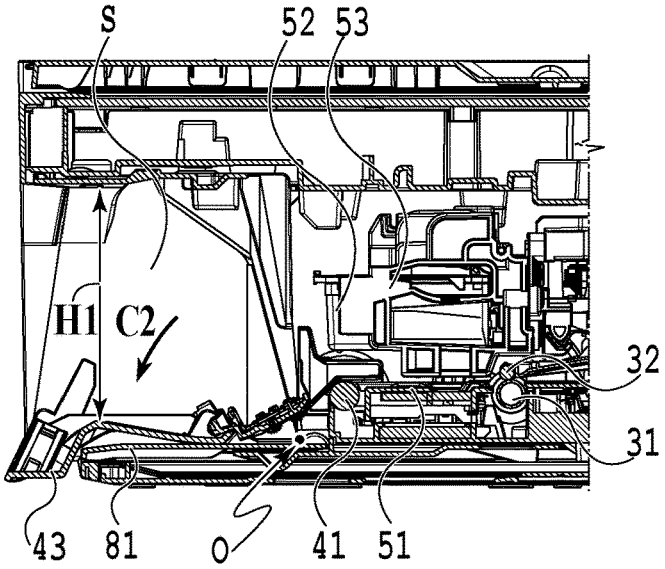
FIGS. 8A, 8B, and 8C are cross-sectional views in different states of main components of the printing apparatus of FIG. 1.

On the back side of the space S, an access cover 43 is provided so as to be opened and closed in the directions of arrows C1 and C2 around an axial line O as the center. The axial line O thereof is positioned at the lower end portion of the access cover 43. By operating the access cover 43 in the direction of the arrow C1, the access cover 43 is closed as illustrated in FIGS. 1 and 3, and by operating in the direction of the arrow C2, the access cover is opened as illustrated in FIG. 8A. When closed, the access cover 43 restricts access to the inside of the printing apparatus 1 from the outside while allowing the sheet to be discharged from the discharge port 4. When the access cover 43 is opened for apparatus maintenance, the access to the inside of the printing apparatus 1 from the outside can be allowed to be performed. Specific examples of the apparatus maintenance include attaching and detaching of the print head 52 to and from the carriage 53, cleaning of the transporting unit 3, the printing unit 5, and the discharge port 4, elimination of sheet jam in the vicinity of the discharge port, and the like. As illustrated in FIG. 4, the access cover 43 is provided with a handle portion 43*a* used for opening the access cover 43 and a lock portion 43*b* for locking the access cover 43 at a closed position. As illustrated in FIG. 4, the handle portion 43*a* and the lock portion 43*b* are provided at positions avoiding an operation range R when the print head 52 is attached to and detached from the carriage 53.

FIGS. 5A to 7 are explanatory diagrams of the configuration and operations of the discharge tray unit 8. The discharge tray unit 8 includes a first (rotating) tray 81, a second (moving) tray 82, a guide member 83, and a stopper member 84. On both sides of the first tray 81 in the width direction of the sheet, right and left rotating shafts 81*a* positioned on the upstream side in the sheet discharging direction are provided. The right and left rotating shafts 81*a* are engaged with right and left holes 83*e* provided in the guide member 83, and the first tray 81 is rotatably attached to the guide member 83. The second tray 82 is positioned on the lower side of the first tray 81 and is guided by the guide member 83 so as to be drawn out and pushed in along the sheet discharging direction. When the second tray 82 is drawn out as illustrated in FIGS. 5C and 6C as described later, the second tray 82 is held so that the end portion thereof on the downstream side in the sheet discharging direction (a tip portion on the front side of the apparatus) is lifted up in comparison with before the second tray is drawn out. The stopper member 84 is rotatably attached to the second tray 82 on the downstream side in the sheet discharging direction, and the guide member 83 is fixed to a fixed position on the bottom surface of the printing apparatus 1.

Figure 5A:
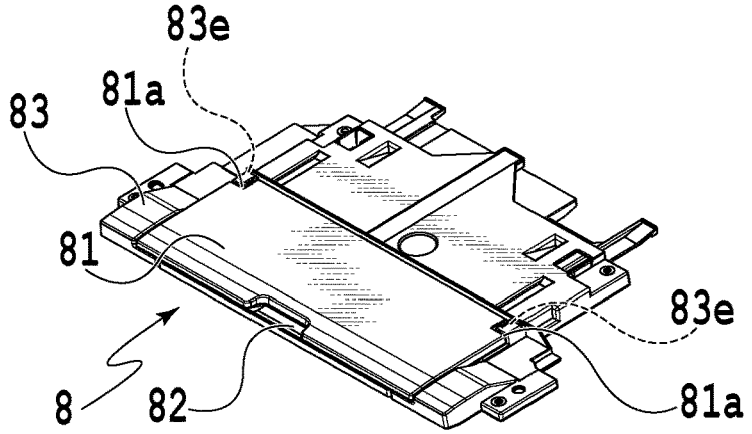
FIGS. 5A, 5B, and 5C are perspective views of different states of a discharge tray unit.
Figure 6A:
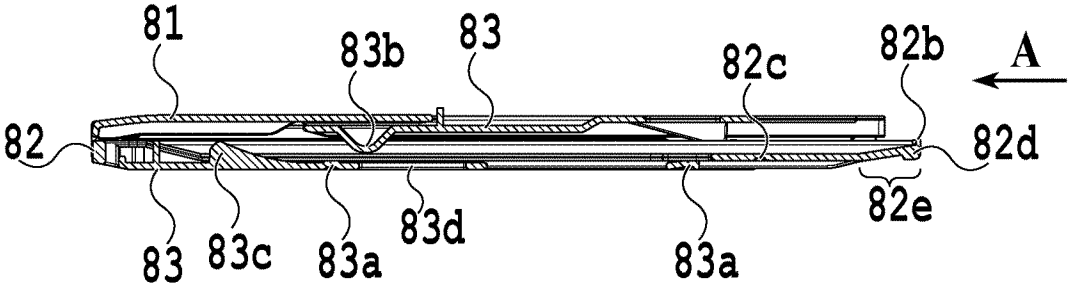
FIGS. 6A, 6B, and 6C are cross-sectional views of different states of the discharge tray unit.
Figure 7:
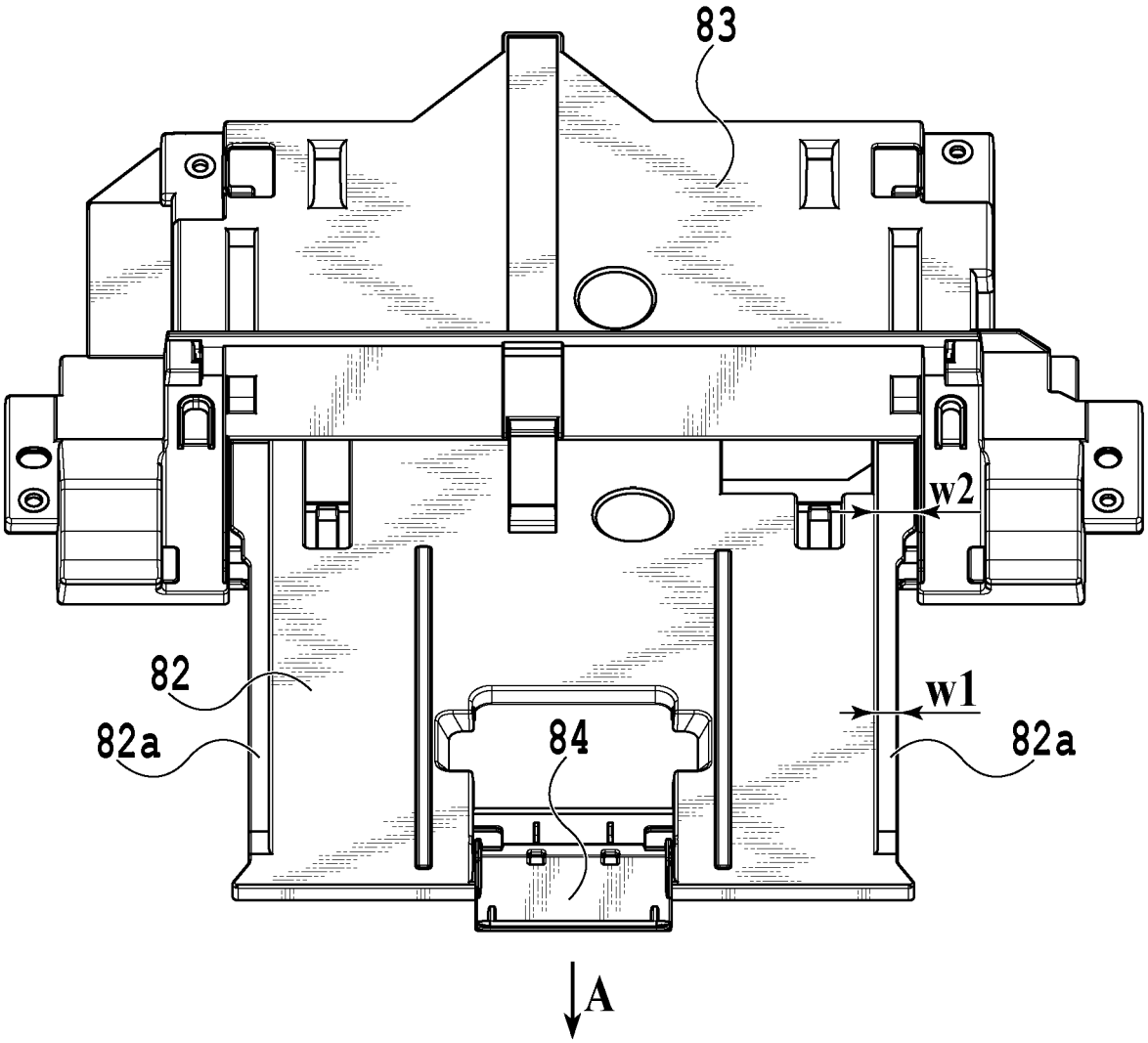
FIG. 7 is a top view of the discharge tray unit of FIG. 5C in a state where a first tray is removed.

In the first state (the first position) where the second tray 82 is pushed in as illustrated in FIGS. 5A and 6A, the portion of the first tray 81 on the downstream side in the discharging direction is supported on the guide member 83. On both sides of the second tray 82 in the width direction of the sheet, right and left guide surfaces 82*a* protruding outward in the width direction of the sheet are formed. The lower surfaces of the right and left guide surfaces 82*a* are in contact with right and left guide surfaces 83*a* of the guide member 83, and the upper surfaces thereof are in contact with right and left restricting portions 83*b* of the guide member 83. Therefore, the right and left guide surfaces 82*a* are held in a state of being interposed between the right and left guide surfaces 83*a* and the right and left restricting portions 83*b*. As illustrated in FIG. 7, with respect to the right and left guide surfaces 82*a*, the protruding amount (W1) of the portion thereof on the downstream side in the sheet discharging direction and the protruding amount (W2) of the portion thereof on the upstream side in the sheet discharging direction are different from each other, and the following relationship W1<W2 is satisfied. In the first position in FIGS. 5A and 6A, the first tray 81 and the second tray 82 do not abut each other.

Figure 5B:
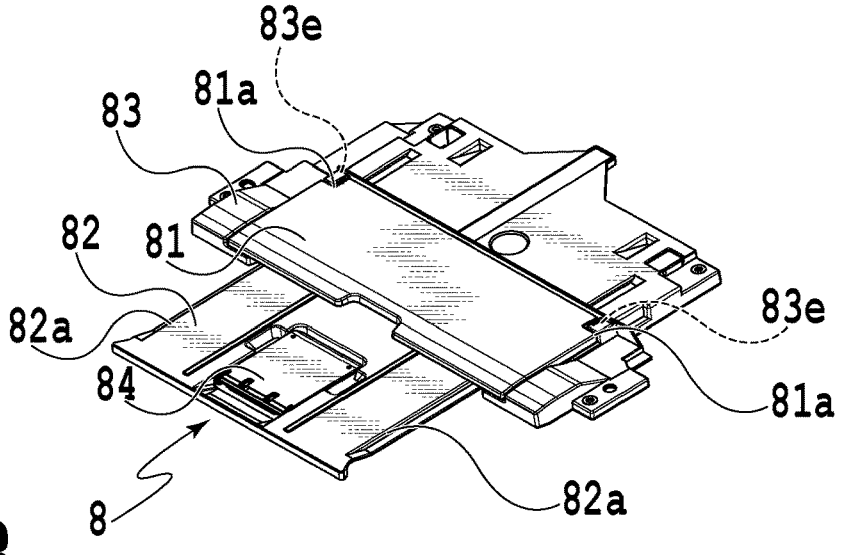
Figure 5C:
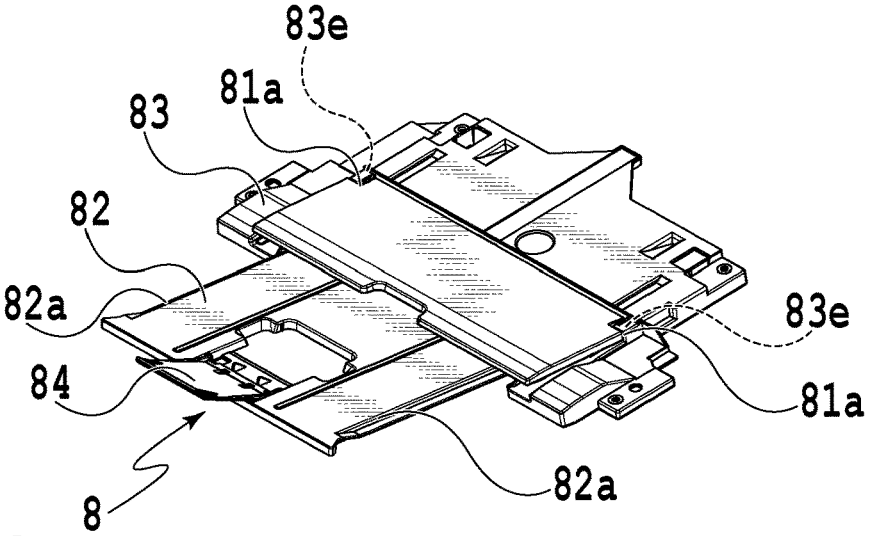
Figure 6B:
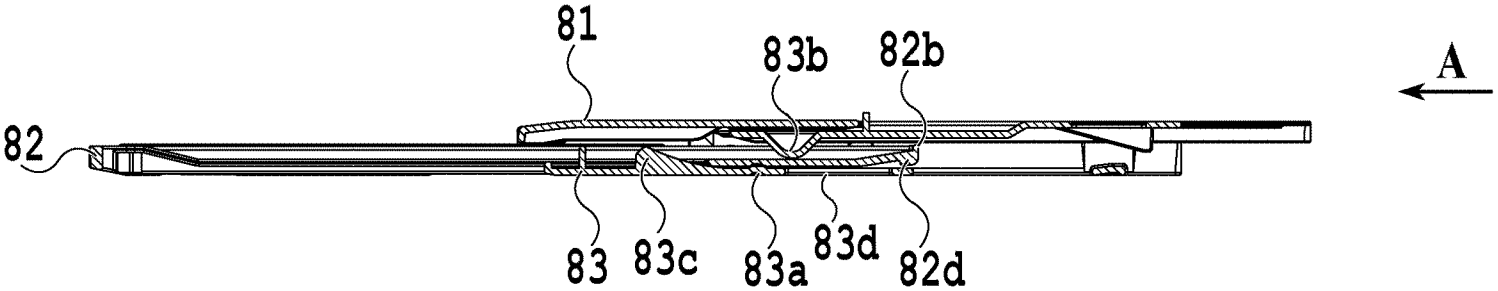
Figure 6C:
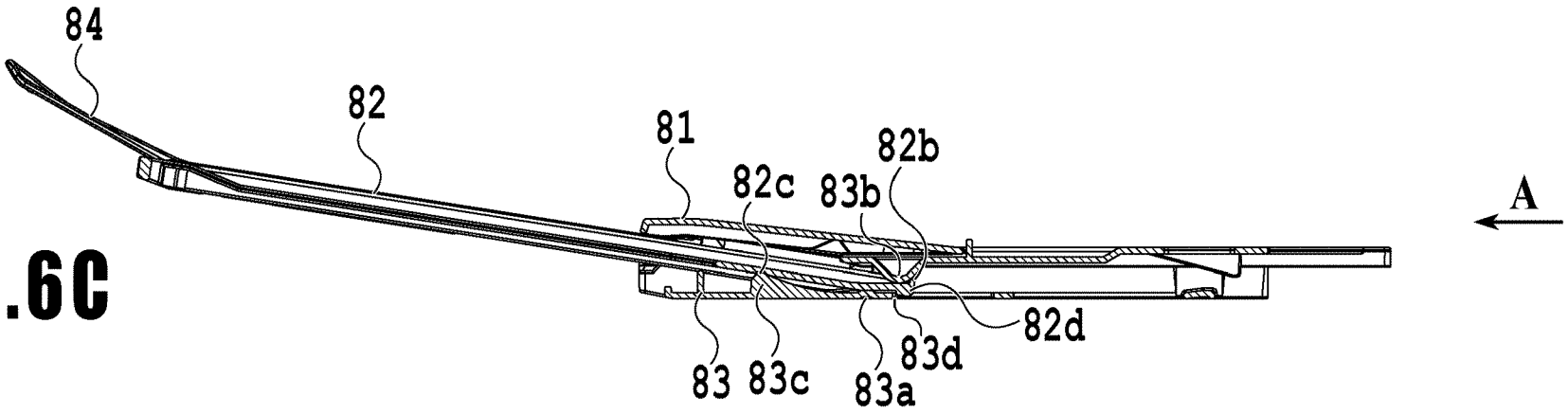

The second tray 82 can be in the second state (second position) where the second tray 82 is drawn out as in FIGS. 5C and 6C from the first position in FIGS. 5A and 6A. In addition, during transition from the first position to the second position and during transition from the second position to the first position, a third state (third position) as illustrated in FIGS. 5B and 6B is interposed.

As illustrated in FIGS. 5B and 6B, the guide surface 82*a* of the second tray 82 in the first position is guided by the guide surface 83*a* and the restricting portion 83*b* to be straightly drawn out to the left side in FIG. 6B (third position). In addition, the second tray 82 is drawn out, so that as illustrated in FIGS. 5C and 6C, the guide surface 82*a* thereof on the downstream side in the sheet discharging direction is lifted up by a protrusion 83*c* and the restricting portion 83*b* of the guide member 83 (second position). When the second tray 82 is drawn out, the guide surface 82*a*, the protrusion 83*c*, and the restricting portion 83*b* function as a cam portion that inclines the portion of the second tray 82 on the downstream portion in the sheet discharging direction so as to face upward. Such a cam portion may be provided as long as the cam portion can incline the second tray 82, and may be provided on at least one of the facing portions of the second tray 82 and the guide member 83. In this manner, in the third state (the third position), the first tray 81 and the second tray 82 maintain the same posture as in the first state (the first position), and in the second state (the second position), the posture thereof is changed so that an inclination angle is increased. The inclination angle is an angle with respect to the sheet discharging direction (in this example, horizontal direction).

The protruding amounts W1 and W2 of the guide surface 82*a* of the second tray 82 are set such that, in the first position and the third position, the guide surface 82*a* does not abut the protrusion 83*c*, and in the second position, the guide surface 82*a* abuts the protrusion 83*c*. As the second tray 82 is inclined as illustrated in FIGS. 5C and 6C, a portion of the first tray 81 on the downstream side in the sheet discharging direction is lifted up by the second tray 82 to be tilted up.

On the guide surface 82*a* of the second tray 82, an inclined portion 82*e* is formed in a portion on the upstream side in the sheet discharging direction. When the second tray 82 is inclined as illustrated in FIG. 6C, interference between the second tray 82 and the guide member 83 is avoided by the inclined portion 82*e*, and thus, the second tray 82 does not protrude in the downward direction of the guide member 83. In addition, a recessed portion 82*c* is provided on the guide surface 82*a*, and when the second tray 82 is inclined as illustrated in FIG. 6C, the protrusion 83*c* is engaged into the recessed portion 82*c* so that the second tray 82 is not pushed in due to its own weight. In addition, in this state, by releasing the engagement between the protrusion 83*c* and the recessed portion 82*c* by slightly lifting up the tip portion of the second tray 82, the second tray 82 can be pushed in and accommodated. In addition, a protrusion 82*b* is provided on the upper surface of the inclined portion 82*e* on the guide surface 82*a*, and when the second tray 82 is inclined as illustrated in FIG. 6C, the protrusion 82*b* abuts the restricting portion 83*b*, so that further drawing-out of the second tray 82 is restricted. In addition, a protrusion 82*d* is provided on the lower surface of the inclined portion 82*e* of the guide surface 82*a*, and when the second tray 82 is inclined as illustrated in FIG. 6C, the protrusion 82*d* is engaged with a hole 83*d* of the guide member 83, so that further drawing-out of the second tray 82 is restricted.

In the second position as illustrated in FIGS. 5C and 6C, the lower surfaces of the first tray 81 and the second tray 82 are supported by the guide member 83 and the like. On the other hand, the first tray 81 and the second tray 82 are rotatable within a predetermined range with respect to the upward direction, and thus, in a case where an external force for unintentionally rotating these trays upward is applied, breakage and the like do not easily occur. In addition, in the second position, the portion of the first tray 81 on the downstream side in the sheet discharging direction is set to be at a position where the portion can receive the tip portion of a small-sized sheet with high rigidity such as a postcard discharged from the discharge port 4. In this manner, in the second position, the portion of the first tray 81 on the downstream side in the discharging direction is set to be at a position in the sheet discharging direction and in the height direction with respect to the discharge port 4, so that the printing unit 5 can perform stable printing on the sheet.

Figure 8B:
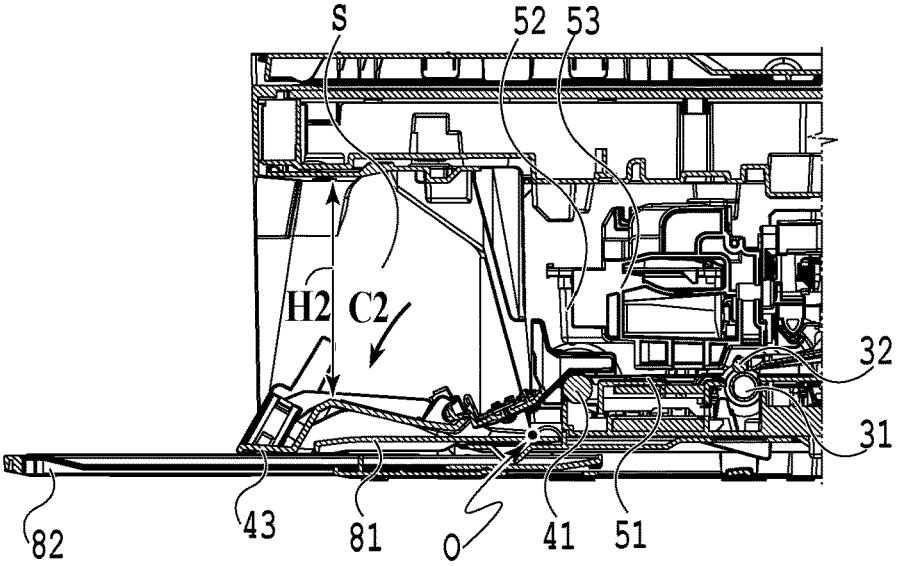
Figure 8C:
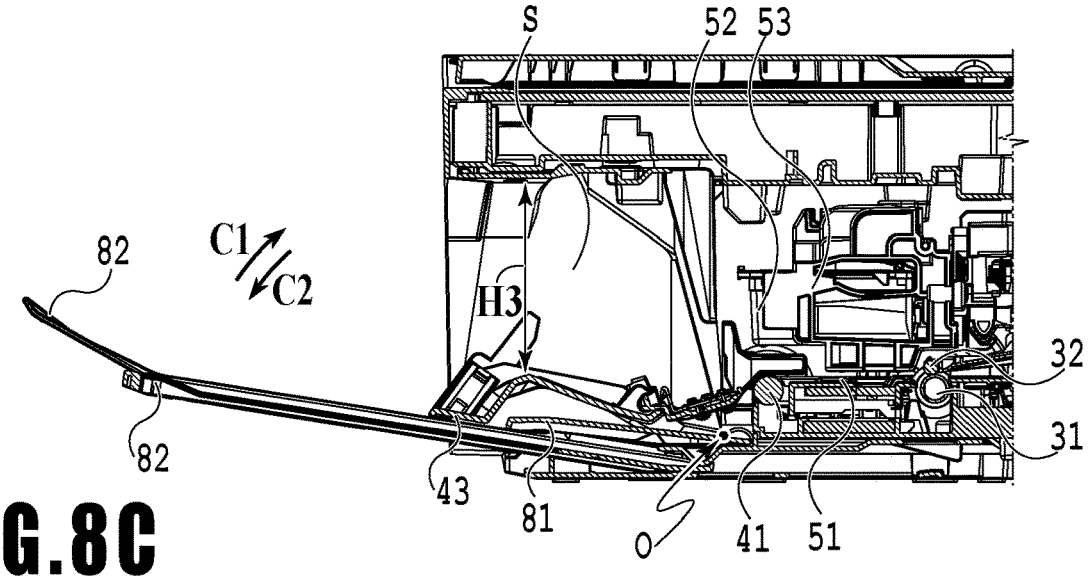

FIGS. 8A, 8B, and 8C are explanatory diagrams of the relationship between the access cover 43 and the discharge tray unit 8.

As illustrated in FIGS. 8A and 8B, in the first position and the third position, when the access cover 43 is opened, the heights H1 and H2 of the space for access to the inside of the printing apparatus are sufficiently secured. More specifically, sufficient heights H1 and H2 are secured so that work such as attachment/detachment of the print head 52, cleaning of the discharge roller 41 and the platen 51, or processing of sheet jam can be easily performed. In the first position in FIG. 8A, since the second tray 82 is not drawn out, the access cover 43 is opened to the maximum in the direction of the arrow C2 without abutting the second tray 82, and thus, the rotation angle (opening angle) of the access cover 43 in the opening direction is large. In the third position in FIG. 8B, since the access cover 43 hits the drawn-out second tray 82 and the access cover 43 is positioned on the upper portion of the second tray 82, the rotation angle (opening angle) of the access cover 43 in the direction of the arrow C2 becomes slightly small. Although the height H2 is slightly smaller than the height H1, the opening angle (opening amount) of the access cover 43 is sufficient.

On the other hand, in the second position as illustrated in FIG. 8C, since the access cover 43 hits the inclined second tray 82, the rotation of the access cover 43 in the direction of the arrow C2 is more greatly restricted. Therefore, the height H3 of the space when the access cover 43 is opened is smaller than the heights H1 and H2, so that it is difficult to perform access to the inside of the printing apparatus. However, the rotation angle (opening angle) of the access cover 43 in the direction of the arrow C2 can be greatly changed by pushing the second tray 82 from the second position in FIG. 8C to the third position in FIG. 8B where the second tray 82 is not inclined. As a result, it is possible to sufficiently secure the access space to the inside of the printing apparatus.

Besides fixing the guide member 83 to the bottom surface of the printing apparatus as in this embodiment, the guide member 83 may be configured to be drawn out from the printing apparatus. In addition, a sheet feeding apparatus may be installed under the discharge tray unit 8.

Second Embodiment

FIGS. 9A, 9B, 9C, 9D, 10A, 10B, and 10C are explanatory diagrams of a discharge tray unit according to a second embodiment of the present invention.

The discharge tray unit according to this embodiment includes a first tray 201, a second tray 202, and a guide member 203. Both end portions of the first tray 201 in the width direction of the sheet are provided with right and left rotating shafts 201*a* positioned in a substantially central portion in the sheet discharging direction. These rotating shafts 201*a* are positioned between an end portion 201*b* on the upstream side in the sheet discharging direction of the first tray 201 and an end portion 201*c* on the downstream side in the sheet discharging direction. That is, an intermediate portion of the first tray 201 in the sheet discharging direction is rotatably supported, and the inclination angle thereof is changed according to the rotational position. The guide member 203 is provided with a bearing 203*a* that holds the rotating shaft 201*a* of the first tray 201 and a receiving portion 203*b* to which the end portion 201*b* of the first tray 201 is fitted.

Figure 9B:
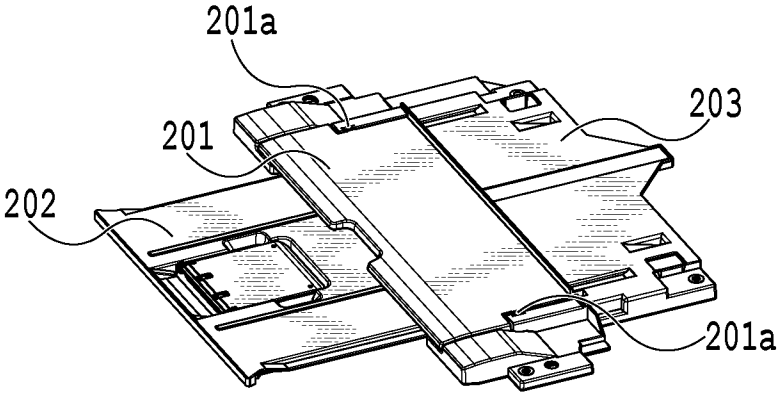
FIGS. 9A, 9B, 9C and 9D are perspective views of different states of a discharge tray unit in a printing apparatus according to a second embodiment of the invention.
Figure 9D:
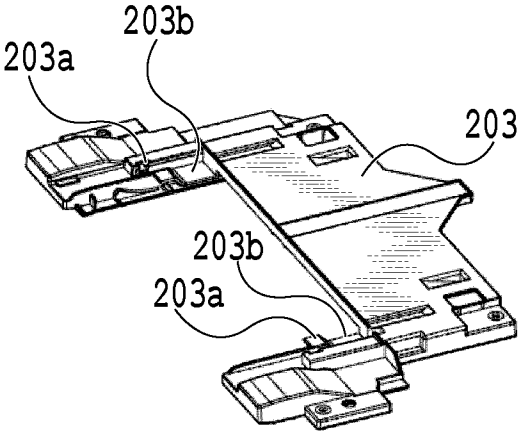
Figure 9A:
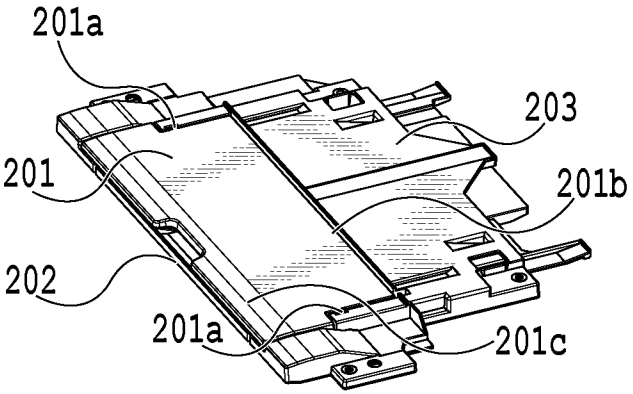
Figure 9C:
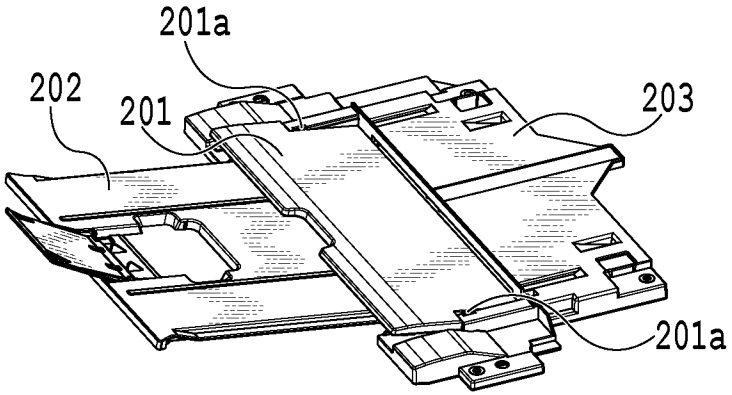
Figure 10A:
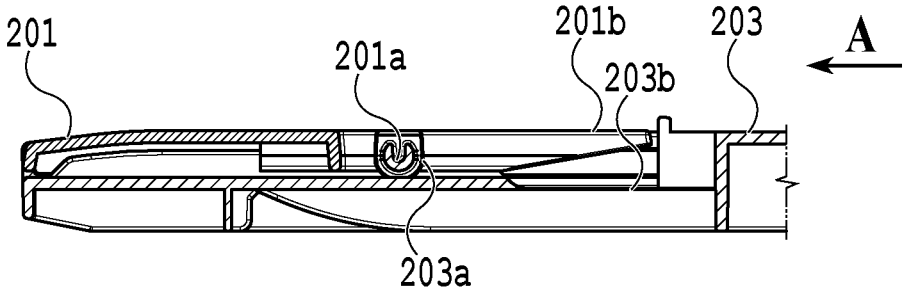
FIGS. 10A, 10B, and 10C are cross-sectional views of different states of the discharge tray unit.
Figure 10B:
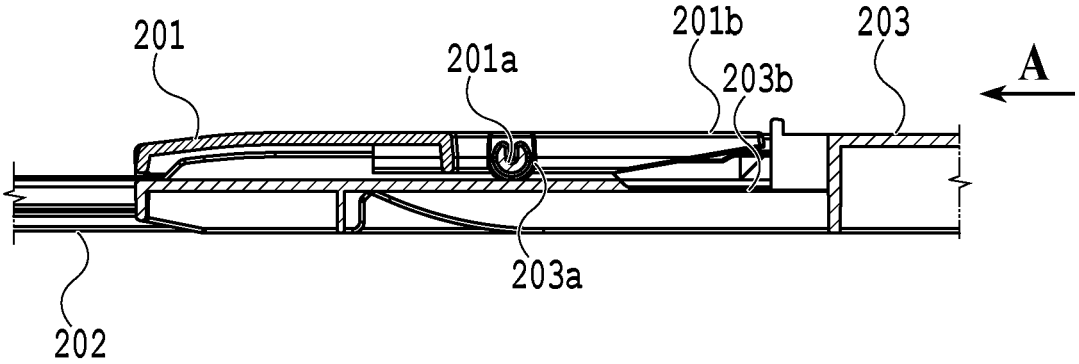
Figure 10C:
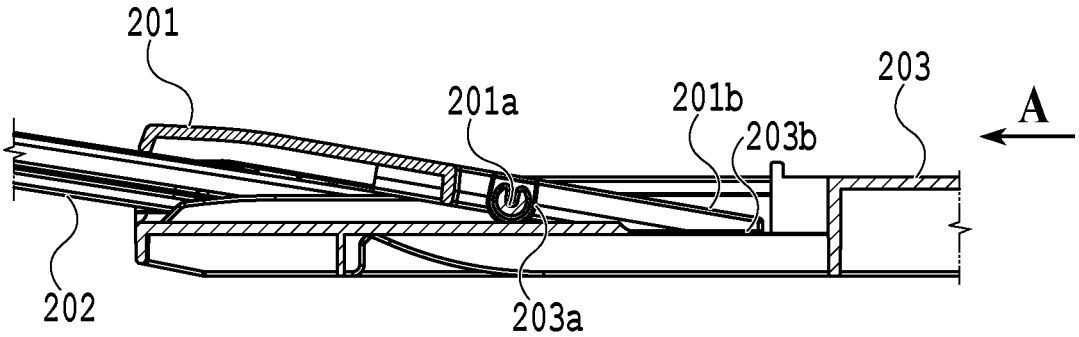

Similarly to the case of the first embodiment, the second tray 202 can be drawn out from the first position in FIGS. 9A and 10A through the third position in FIGS. 9B and 10B to the second position in FIGS. 9C and 10C. Similarly to the case of the first embodiment, the downstream side of the second tray 202 in the sheet discharging direction is lifted up according to the shape of the guide portion of the guide member 203. The end portion 201*c* of the first tray 201 is lifted up by the second tray 202 so as to be tilted up. At that time, as the first tray 201 rotates about the rotating shaft 201*a*, the end portion 201*b* of the first tray 201 is lowered to be positioned within the receiving portion 203*b* of the guide member 203. As described above, in the second position, the end portion 201*b* of the first tray 201 is lowered, and the end portion 201*b* moves away from the discharge port for the sheets in the printing apparatus, so that the stacking capacity of the sheets in the discharge tray unit can be increased.

In addition, when the portion of the second tray 202 on the downstream side in the sheet discharging direction is lifted up by the user, the end portion 201*b* of the first tray 201 hits the receiving portion 203*b* of the guide member 203, so that the rotation is restricted. Therefore, there is no possibility of the first tray 201 colliding with a desk or the like.

Third Embodiment

Figure 11A:
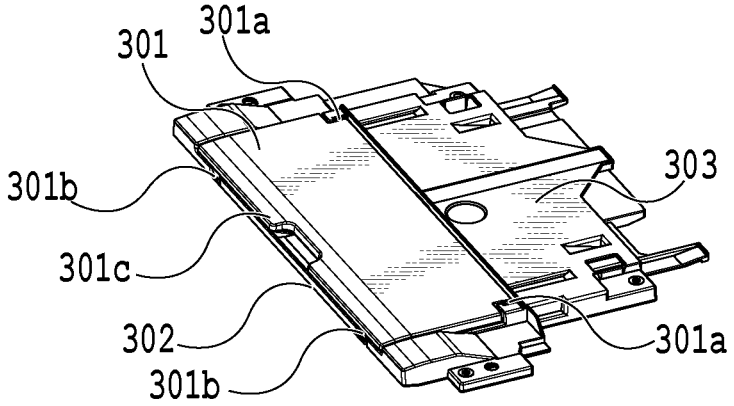
FIGS. 11A, 11B, and 11C are perspective views of different states of a discharge tray unit in a printing apparatus according to a third embodiment of the invention.
Figure 11B:
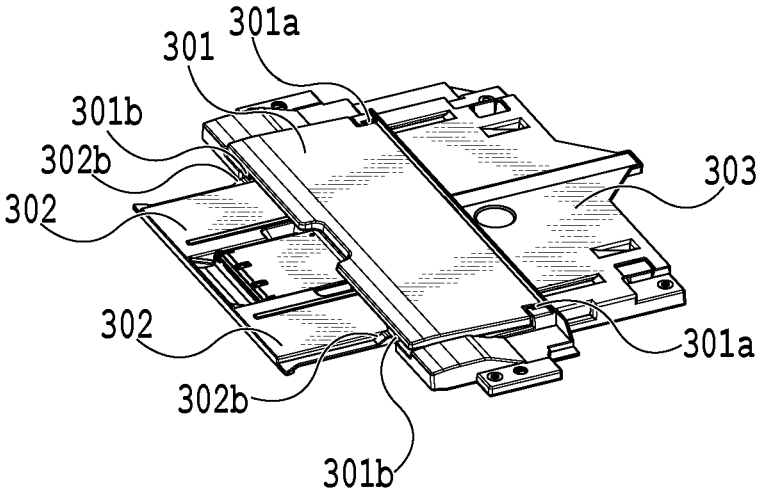
Figure 11C:
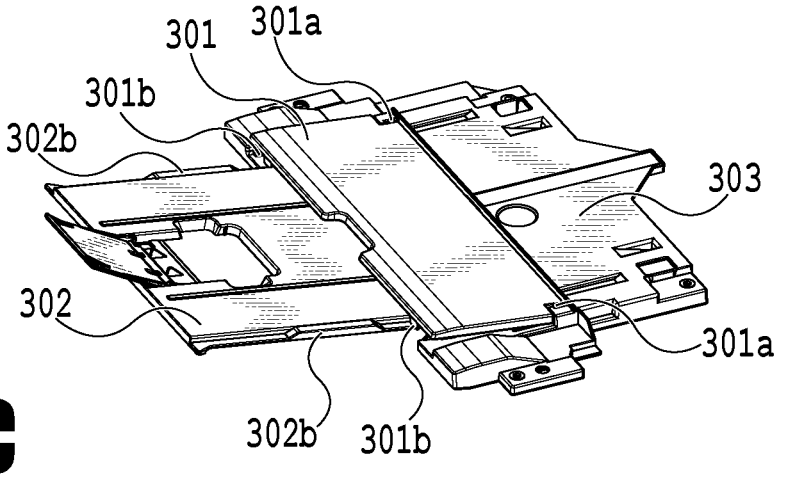

FIGS. 11A, 11B, and 11C are explanatory diagrams of a discharge tray unit according to a third embodiment of the present invention.

The discharge tray unit according to this embodiment includes a first tray 301, a second tray 302, and a guide member 303. The first tray 301 includes right and left rotating shafts 301*a* positioned on the upstream side in the sheet discharging direction and right and left protrusions 301*b* and an end portion 301*c* positioned on the downstream side in the discharging direction. Right and left protrusions 302*b* are provided on the second tray 302, and in the first position in FIG. 11A where the first and second trays 301 and 302 are in the accommodated state, the protrusion 302*b* is not in contact with the first tray 301. In the third position in FIG. 11B where the second tray 302 has been drawn straight out, the protrusion 302*b* of the second tray 302 lifts up the protrusion 301*b* of the first tray 301. The protrusions 301*b* and 302*b* constitute a mechanism for tilting up the first tray 301 in conjunction with the drawing-out of the second tray 302 and changing the inclination angle thereof to be increased. More specifically, the protrusion 301*b* and the protrusion 302*b* function as a cam portion that inclines the portion of the second tray 82 on the downstream side in the sheet discharging direction so as to face upward according to the relative movement between the first tray 301 and the second tray 82. Such a cam portion may be provided as long as the cam portion can change the inclination angle of the second tray 82 and may be provided on at least one of the facing portions of the first tray 81 and the second tray 82. In addition, the cam portion may be configured to change the inclination angle of the first tray 81 in a plurality of stages according to the relative movement between the first tray 81 and the second tray 82.

As described above, in the third position, the protrusion 302*b* of the second tray 302 lifts up the protrusion 301*b* of the first tray 301, so that the first tray 301 rotates about the rotating shaft 301*a*, and thus, the end portion 301*c* is lifted. Therefore, it is possible to lift up the first tray 301 by a predetermined amount and incline the first tray 301 to a desired angle without drawing out the second tray 302 to the second position in FIG. 11C. Therefore, in particular, when printing on a short sheet, the discharge tray unit according to this embodiment inclines the first tray 301 by drawing out the second tray 302 by an amount corresponding to the length of the sheet, so that it is possible to ensure necessary discharge performance. In the second position in FIG. 11C, similarly to the above-described embodiments, the first tray 301 is inclined by the second tray 302 according to the shape of the guide portion of the guide member 303.

The installation position of the rotating shaft 301*a* of the first tray 301 is not limited to the position on the upstream side in the sheet discharging direction, and similarly to the second embodiment, the installation position may be a substantially central portion of the first tray 301 in the sheet discharging direction.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2017-114342, filed Jun. 9, 2017, which is hereby incorporated by reference herein in its entirety.

What is claimed is:

1. A printing apparatus comprising:

a printing unit configured to print on a sheet;

a discharge port configured to discharge a sheet printed on by the printing unit, the sheet being discharged in a discharging direction;

a guide member fixed to the printing apparatus;

a moving tray configured to move between a first position at which the moving tray is accommodated in the guide member and a second position at which the moving tray is capable of stacking the sheet discharged from the discharge port, wherein the moving tray is capable of being drawn out to a third position between the first position and the second position;

a rotating tray configured to rotate relative to the guide member by a shaft which engages the rotating tray and the guide member, the rotating tray being positioned at an upper side of the moving tray so as to be capable of stacking the sheet discharged from the discharge port; and a cam portion configured to change an inclination angle of the moving tray by abutting against the moving tray, wherein in a case in which the moving tray is moved from the first position to the second position, (i) the inclination angle of the moving tray is changed by abutting on the cam portion so that a downstream side of the moving tray with respect to the discharging direction is higher than an upstream side of the moving tray, and (ii) the rotating tray is rotated around the shaft by abutting against the moving tray so that a downstream side of the rotating tray with respect to the discharging direction is higher than an upstream side of the rotating tray, and the inclination angle in a case in which the moving tray is at the third position is the same as the inclination angle in a case in which the moving tray is at the first position.

2. The printing apparatus according to claim 1, further comprising:

an access cover configured to be movable to positions allowing and restricting access for maintenance from an outside to an inside of the printing apparatus through a space formed above the rotating tray, wherein the access cover allows the sheet to be discharged from the discharge port to the rotating tray in a case in which the access cover moves to the position restricting the access.

3. The printing apparatus according to claim 2, wherein the access cover is rotatable about a lower end thereof to the positions allowing and restricting the access, and wherein an upper end of the access cover is positioned on the moving tray drawn out from the guide member in a case in which the access cover rotates to the position allowing the access.

4. The printing apparatus according to claim 1, wherein in a case in which the moving tray is at the second position, the inclination angle of the moving tray is greater than an inclination angle of the rotating tray.

5. The printing apparatus according to claim 1, wherein the shaft is arranged inside a main body of the printing apparatus at a time of discharging the sheet.

6. A printing apparatus comprising:

a printing unit configured to print on a sheet;

a discharge port configured to discharge a sheet printed on by the printing unit, the sheet being discharged in a discharging direction;

a guide member fixed to the printing apparatus;

a moving tray configured to move between a first position at which the moving tray is accommodated in the guide member and a second position at which the moving tray is capable of stacking the sheet discharged from the discharge port; and a rotating tray configured to rotate at the guide member by a shaft which engages the rotating tray and the guide member, the rotating tray being positioned at an upper side of the moving tray so as to be capable of stacking the sheet discharged from the discharge port, the shaft being arranged inside a main body of the printing apparatus at a time of discharging the sheet, wherein in a case in which the moving tray is moved from the first position to the second position, (i) an inclination angle of the moving tray is changed so that a downstream side of the moving tray with respect to the discharging direction is higher than an upstream side of the moving tray, and (ii) the rotating tray is rotated around the shaft so that a downstream side of the rotating tray with respect to the discharging direction is higher than an upstream side of the rotating tray.

7. The printing apparatus according to claim 6, wherein the shaft is engaged with a hole provided on the guide member.

8. The printing apparatus according to claim 6, wherein a space in which the rotating tray can rotate is formed inside the main body of the printing apparatus and above the rotating tray.

9. The printing apparatus according to claim 6, wherein the moving tray is capable of being drawn out to a third position between the first position and the second position, and wherein the inclination angle in a case in which the moving tray is at the third position is the same as the inclination angle in a case in which the moving tray is at the first position.

10. The printing apparatus according to claim 6, further comprising:

an access cover configured to be movable to positions allowing and restricting access for maintenance from an outside to an inside of the printing apparatus through a space formed above the rotating tray, wherein the access cover allows the sheet to be discharged from the discharge port to the rotating tray in a case in which the access cover moves to the position restricting the access.

11. A printing apparatus comprising:

a printing unit configured to print on a sheet;

a discharge port configured to discharge a sheet printed on by the printing unit, the sheet being discharged in a discharging direction;

a guide member fixed to the printing apparatus;

a moving tray configured to move between a first position and a second position, wherein the moving tray is capable of being drawn out to a third position between the first position and the second position; and a rotating tray configured to rotate relative to the guide member by a shaft which engages the rotating tray and the guide member, the rotating tray being positioned at an upper side of the moving tray so as to be capable of stacking the sheet discharged from the discharge port, wherein in a case in which the moving tray is moved from the first position to the second position, (i) an inclination angle of the moving tray is changed so that a downstream side of the moving tray with respect to the discharging direction is higher than an upstream side of the moving tray, and (ii) the rotating tray is rotated around the shaft so that a downstream side of the rotating tray with respect to the discharging direction is higher than an upstream side of the rotating tray, and the inclination angle in a case in which the moving tray is at the third position is the same as the inclination angle in a case in which the moving tray is at the first position.

* * * * *